US006234084B1

(12) United States Patent
Neubauer et al.

(10) Patent No.: US 6,234,084 B1
(45) Date of Patent: May 22, 2001

(54) WAGON BODY

(75) Inventors: Joerg Neubauer, Moenchengladbach; Robert Schlett, Duesseldorf; Juergen Schnaas, Leichlingen, all of (DE)

(73) Assignee: Siemens Duewag Schienenfahrzeuge GmbH, Krefeld (DE)

( * ) Notice: Subject to any disclaimer, the term of this patent is extended or adjusted under 35 U.S.C. 154(b) by 0 days.

(21) Appl. No.: 09/297,457

(22) PCT Filed: Nov. 7, 1997

(86) PCT No.: PCT/DE97/02638

§ 371 Date: May 1, 1999

§ 102(e) Date: May 1, 1999

(87) PCT Pub. No.: WO98/23475

PCT Pub. Date: Jun. 4, 1998

(30) Foreign Application Priority Data

Nov. 27, 1996 (DE) ..... 196 49 041

(51) Int. Cl.[7] ..... B61D 17/00

(52) U.S. Cl. ..... 105/396; 105/397; 105/401; 105/404; 105/409; 105/413; 105/412

(58) Field of Search ..... 105/396, 397, 105/401, 404, 409, 413, 422

(56) References Cited

U.S. PATENT DOCUMENTS

| | | | | |
|---|---|---|---|---|
| 4,007,567 | * | 2/1977 | Mooney et al. | 52/262 |
| 4,222,335 | * | 9/1980 | McQueston et al. | 105/397 |
| 4,647,101 | * | 3/1987 | Ruggeri | 296/10 |
| 5,042,395 | * | 8/1991 | Wackerle et al. | 105/397 |
| 5,601,034 | * | 2/1997 | Tao et al. | 105/423 |
| 5,685,229 | * | 11/1997 | Ohara et al. | 105/397 |

* cited by examiner

*Primary Examiner*—S. Joseph Morano
*Assistant Examiner*—Frantz F. Jules
(74) *Attorney, Agent, or Firm*—Michael J. Striker

(57) ABSTRACT

A carriage body of a railroad car has an undercarriage, a floor slab, side wall parts, and a roof, the floor slab having a width which together with a thickness of the side wall parts which face one another defining a functional size of a width of the carriage body, the undercarriage having a width which is less than the functional size of the width of the carriage body, the side wall parts being connected in a force-transmitting fashion to the undercarriage.

9 Claims, 5 Drawing Sheets

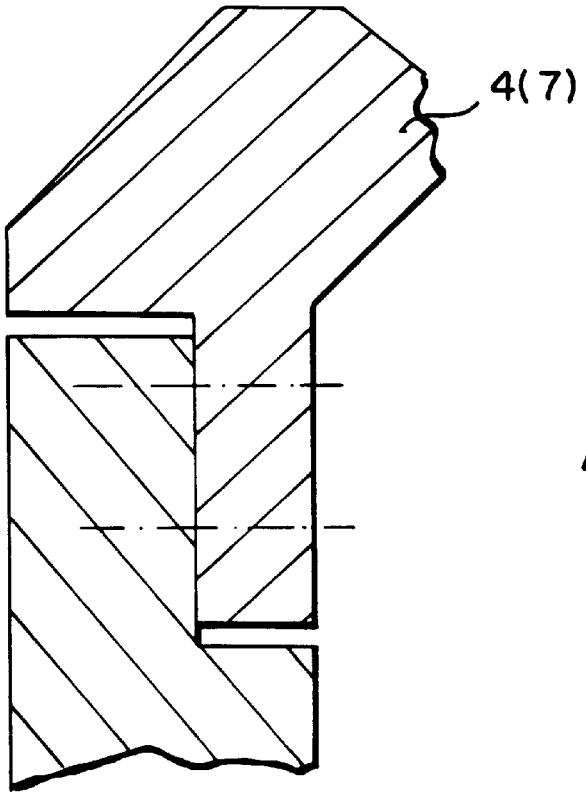
FIG. 4
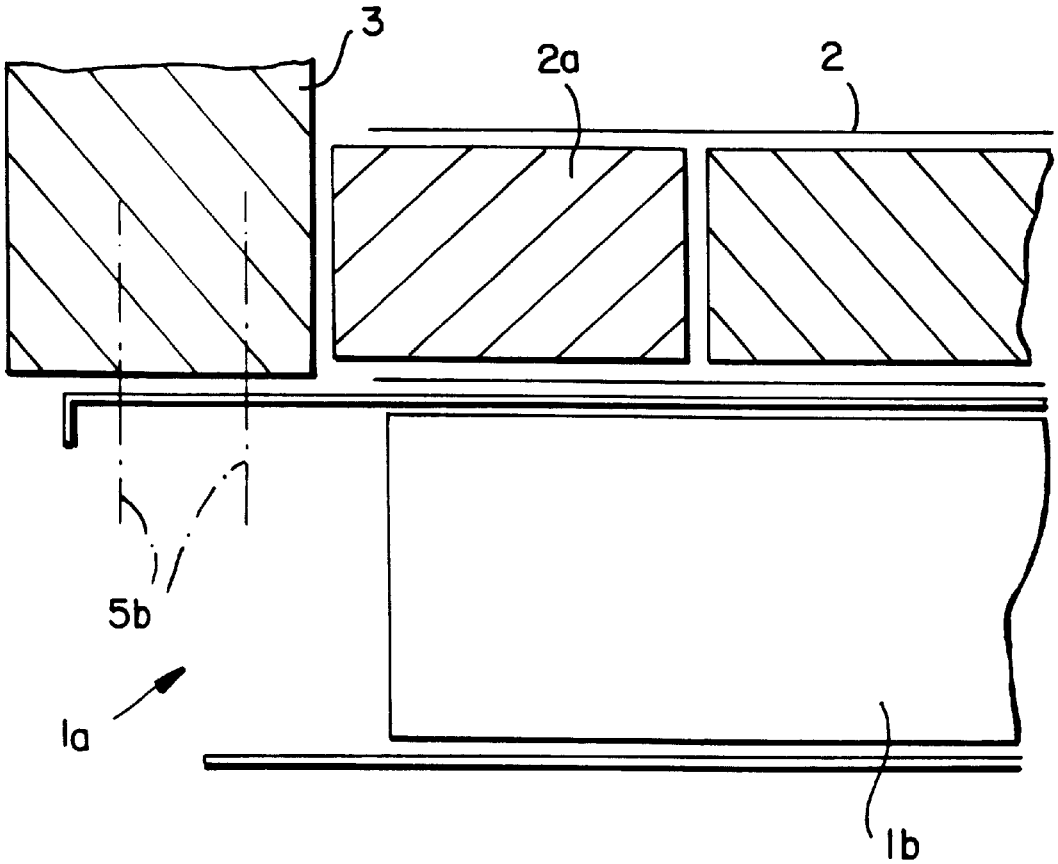

3
5a
6
2a
5a
2
6
3a
1b
5

WAGON BODY

BACKGROUND OF THE INVENTION

The invention relates to a carriage body of a railroad car, essentially formed of an undercarriage, a one-piece or multiple-part floor slab, side wall parts, and a roof.

It is usual in railroad car building to form at least the undercarriage of the carriage body from steel or lightweight metal profiles which are joined together by welding. The outer transverse spacing of lateral longitudinal girders of the undercarriage determines the functional size of the carriage body width. In order among other goals to achieve this functional size within existing tolerances, heavy and expensive production equipment and tools are employed. Furthermore, the dimensional changes in the undercarriage, above all from shrinkage, that occur in welding work must be taken suitably into account and as a rule must be compensated for later by expensive straightening work.

SUMMARY OF THE INVENTION

The object of the invention is considered to be attaining the functional size of the carriage body width, in a carriage body of the above generic type, in an especially simple and economical way, without special production equipment and independently of tolerances of the undercarriage.

According to the invention, this object is attained in that the floor slab serves as a device for joining together the carriage body and by its width—together with the thickness of two facing side wall parts—defines the functional size of the carriage body width.

In the carriage body of the invention, the functional size of the carriage body width is no longer affected by the design of the undercarriage. Thus wide dimensional tolerances can be allowed for the undercarriage with respect to its width and also with respect to its dimensions in the direction toward the rail. The undercarriage should merely be such on its top side that large-area support of the one-piece or multiple-part floor slab exists. It is easy to achieve the exact width, required for the functional size of the carriage body width, of the floor slab, which in the simplest case is of plywood. The carriage body of the invention can be made especially inexpensively, and because the complicated production equipment required earlier can be dispensed with, it can be made practically anywhere.

BRIEF DESCRIPTION OF THE DRAWINGS

The invention is described in further detail below in conjunction with exemplary embodiments shown in principle in the drawing.

FIG. 3 and FIG. 4 are cross sections as supplements to FIG. 1 and FIG. 2, respectively.

DESCRIPTION OF PREFERRED EMBODIMENTS

Figure 1:
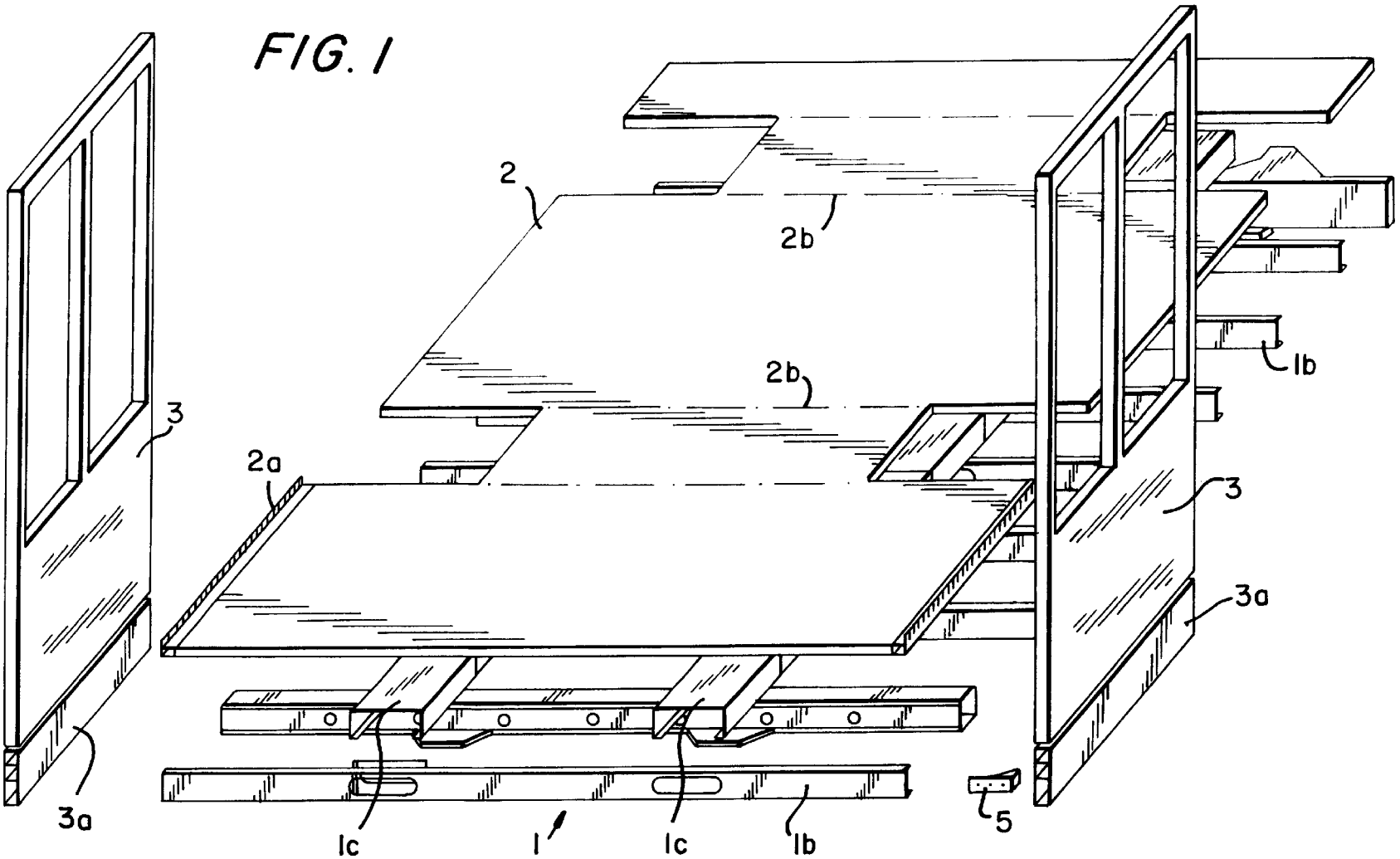
FIG. 1 and FIG. 2 show construction modules of carriage bodies embodied according to the invention.
Figure 2:
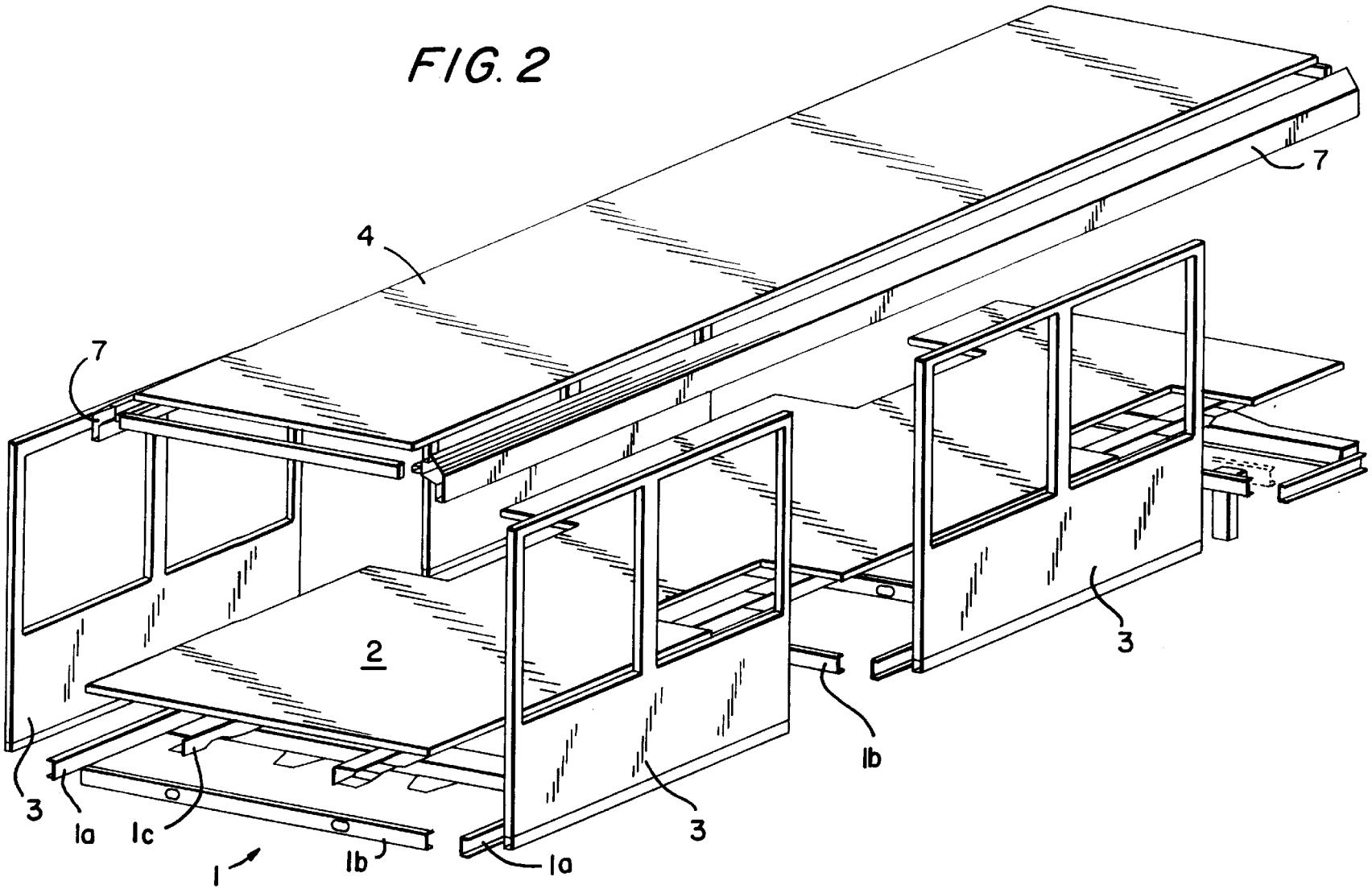

The carriage bodies of FIGS. 1 and 2 substantially each comprise an undercarriage 1, a floor slab 2, side wall parts 3, and a roof 4 that can be seen in FIG. 2. The undercarriage 1, serving primarily to transmit longitudinal forces, has transverse girders 1*b* and middle longitudinal girders 1*c*, as well as lateral longitudinal girders 1*a* in the exemplary embodiment of FIG. 2. The floor slab, embodied in one piece or, as indicated by the partition lines 2*b* in FIG. 1, in multiple parts, is supported on the undercarriage 1 and secured to it; the center axis of the undercarriage 1 and the center axis of the floor slab 2 are disposed in alignment with one another.

Figure 3:
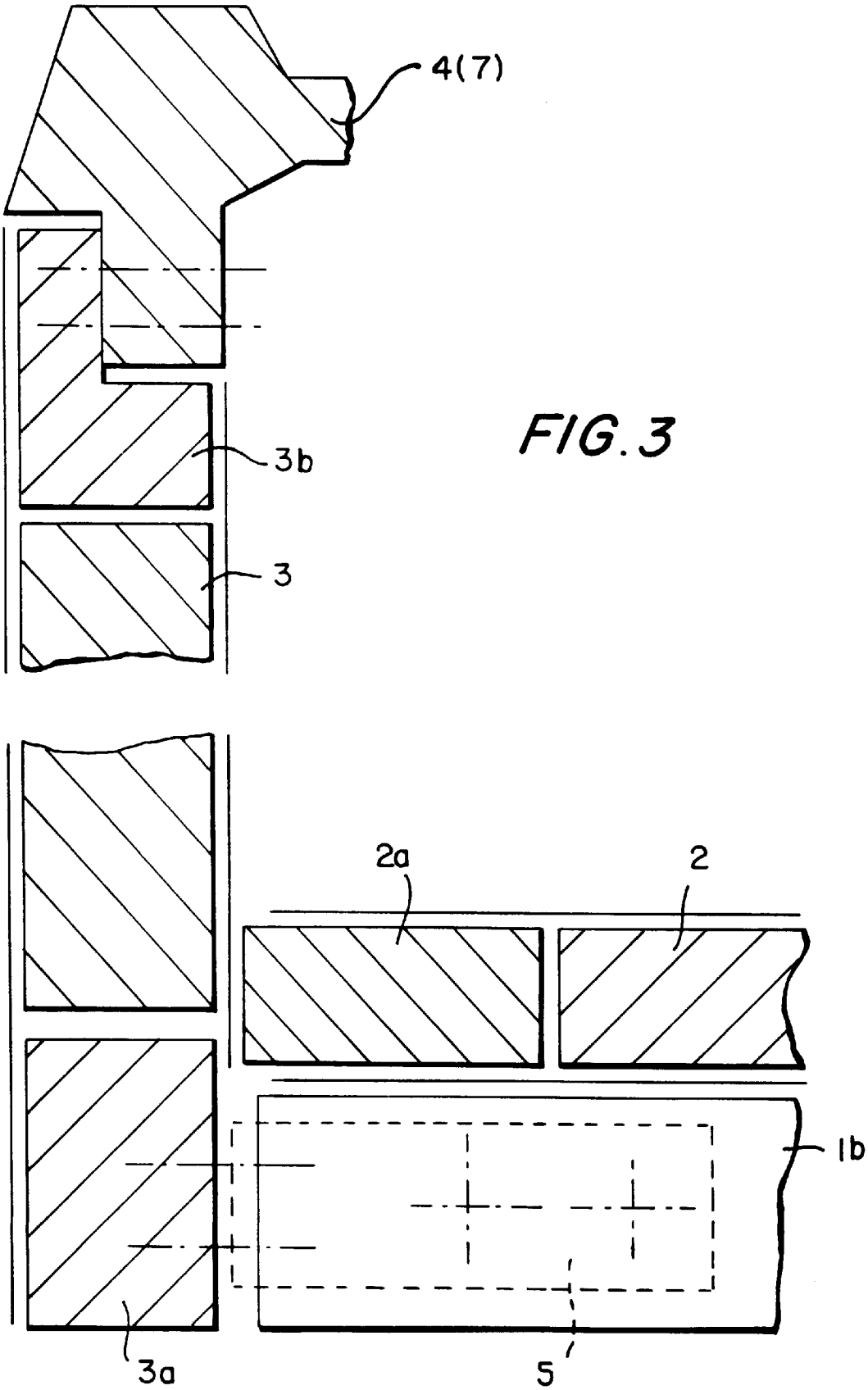

The floor slab 2 serves as a device for joining together the carriage body, or in other words as a stop for the side wall parts 3, and in this way by its width, together with the thickness of two facing side wall parts 3, it defines the functional size of the carriage width. The width of the undercarriage 1 is always less than the aforementioned functional size; there is a transverse spacing, in FIG. 3 between the undercarriage 1 and a lower longitudinal girder 3*a* included in the side wall part 3, and in FIG. 4 between the lateral longitudinal girder 1*a* of the undercarriage 1 and the outer face of the side wall part 3.

Figure 5:
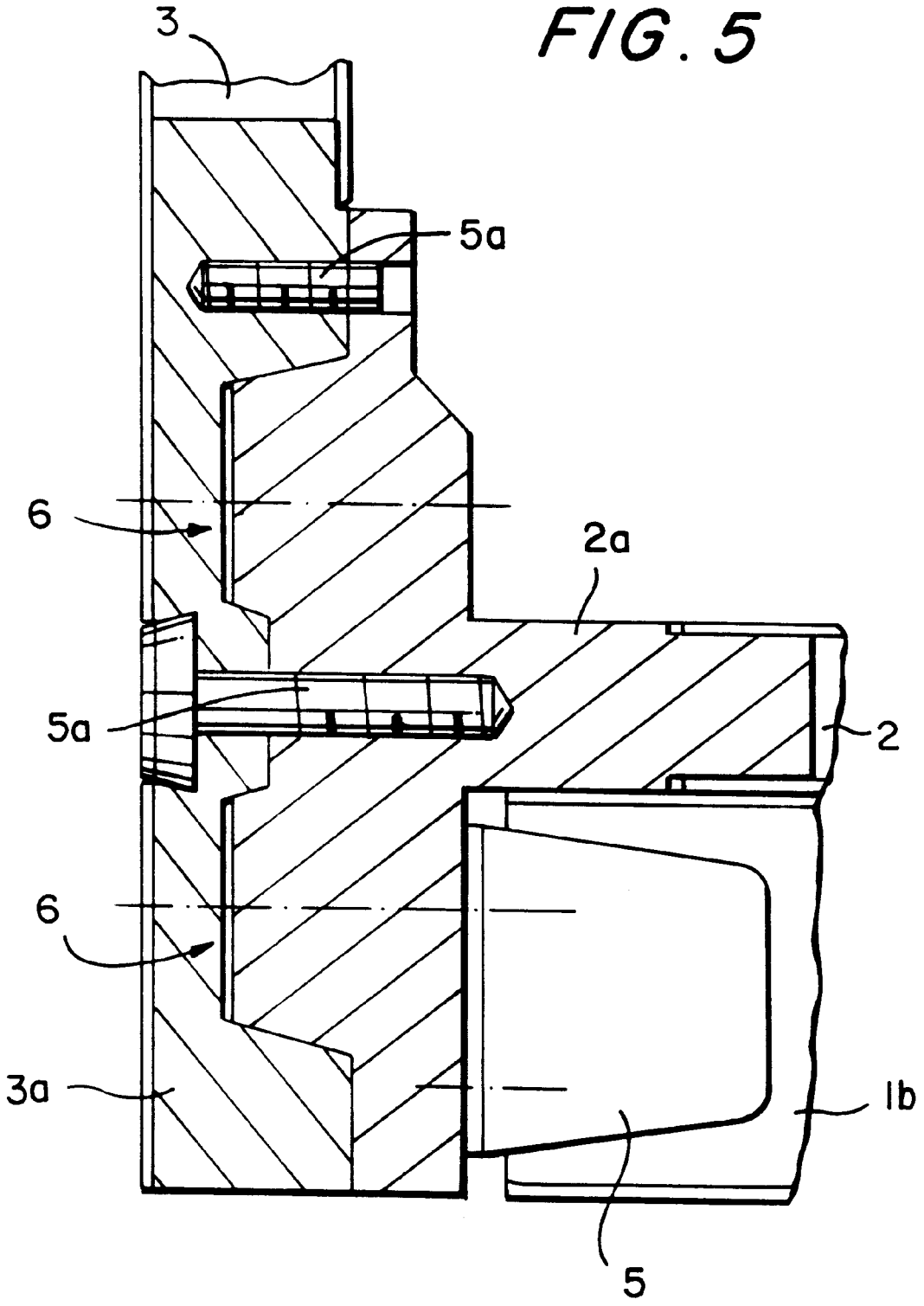
FIG. 5 shows a modification of FIG. 3.

The side wall parts 3, after being brought to the floor slab 2, are connected in force-transmitting fashion to the undercarriage 1. Simple connection angle irons, visible in FIGS. 1, 3 and 5, serve as force-transmitting elements 5; they are screwed on the one hand to the transverse girders 1*b* of the undercarriage 1 and on the other to the lower longitudinal girder 3*a* of the respective side wall part 3 (see FIG. 3) or to a stop profile 2*a* of the floor slab 2 (FIG. 5). In FIG. 5, the lower longitudinal girder 3*a* of the side wall part 3 is held by screws 5*a* on the step profile 2*a* of the floor slab 2; the force transmission is effected by area pressure on wedgelike sets of teeth 6, which cooperate in form-locking fashion, of the side wall part 3 and of the floor slab 2. In the version of the carriage body in FIGS. 2 and 4, the force-transmitting connection of the side wall part 3 to the lateral longitudinal girders 1*a* of the undercarriage 1 is achieved by connection screws in the working lines 5*b*.

The floor slab 2, side wall parts 3 and roof 4 can each be designed as an integral sandwich, in which two outer cover layers are glued to load-bearing and insulating structural foam. This integral sandwich also includes the interface, not visible from outside and embodied for the sake of simple dismantling—such as the connection profile 2*a* or the lower longitudinal girders 3*a*—with the adjacent components. For forming this kind of interface in the roof, an upper fastening profile 3*b* for the roof 4 or for a top flange 7 is also integrated into the side wall part 3 in FIG. 3; the roof 4 is retained on the two opposed top flanges 7—see FIG. 2.

List of Reference Numerals

| | |
|---|---|
| 1 | Undercarriage |
| 1a | Lateral longitudinal girder |
| 1b | Transverse girder |
| 1c | Middle longitudinal girder |
| 2 | Floor slab |
| 2a | Stop profile |
| 2b | Partition line in the multiple-part version |
| 3 | Side wall part |
| 3a | Lower longitudinal girder |
| 3b | Upper fastening profile |
| 4 | Roof |
| 5 | Force-transmitting element |
| 5a | Screw |
| 5b | Working line of a connecting screw |
| 6 | Wedgelike set of teeth |
| 7 | Top flange |

What is claimed is:

1. A carriage body of a railroad car, comprising an undercarriage; a floor slab; side wall parts; and a roof, said floor slab having a width which together with a thickness of said side wall parts which face one another defining a functional size of a width of said carriage body, said undercarriage having a width which is less than the functional size of the width of said carriage body, said side wall parts being connected in a force-transmitting fashion to said undercarriage, said side wall parts in said undercarriage being arranged so that a transverse spacing is provided between a respective one of said side wall parts and said undercarriage; and further comprising force-transmitting elements which extend over said transverse spacing.

2. A carriage body as defined in claim 1, wherein said floor slab is formed as a one-piece floor slab.

3. A carriage body as defined in claim 1, wherein said floor slab is formed as a multiple-part floor slab.

4. A carriage body as defined in claim 1, wherein said force-transmitting elements are formed as connecting angle irons.

5. A carriage body as defined in claim 1, wherein said side wall parts and said floor slab are joined together in a force-transmitting fashion.

6. A carriage body as defined in claim 1, wherein at least one element selected from the group consisting of said floor slab, said side wall parts, and said roof is formed as an integral sandwich.

7. A carriage body as defined in claim 6, wherein said integral sandwich includes an interface with adjacent components, which is not visible from outside.

8. A carriage body of a railroad car, comprising an undercarriage; a floor slab; side wall parts; and a roof, said floor slab having a width which together with a thickness of said side wall parts which face one another defining a functional size of a width of said carriage body, said undercarriage having a width which is less than the functional size of the width of said carriage body, said side wall parts being connected in a force-transmitting fashion to said undercarriage, said floor slab having long edges provided with stop profiles for said side wall parts, said stop profiles being arranged so that a transverse spacing of said stop profiles in connection with the thickness of said side walls determining the functional size of the width of said carriage body.

9. A carriage body of a railroad car, comprising an undercarriage; a floor slab; side wall parts; and a roof, said floor slab having a width which together with a thickness of said side wall parts which face one another defining a functional size of a width of said carriage body, said undercarriage having a width which is less than the functional size of the width of said carriage body, said side wall parts being connected in a force-transmitting fashion to said undercarriage, said floor slab and said side walls cooperating in a form-locking fashion via wedge-like sets of teeth, so that a force transmission is provided by a flank pressure on said sets of teeth.

* * * * *